United States Patent [19]

Koriyama et al.

[11] 4,401,139

[45] Aug. 30, 1983

[54] WEFT PICKING DEVICE OF AIR JET LOOM

[75] Inventors: Masayuki Koriyama; Kimimasa Ohnishi, both of Tokyo; Takao Ishido, Higashikurume, all of Japan

[73] Assignee: Nissan Motor Co., Ltd., Yokohama, Japan

[21] Appl. No.: 250,005

[22] Filed: Apr. 1, 1981

[30] Foreign Application Priority Data

Apr. 11, 1980 [JP] Japan ..... 55-46874

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 4,183,382 1/1980 Scheffel ..... 139/435
4,295,500 10/1981 Suaty ..... 139/435

FOREIGN PATENT DOCUMENTS 195638 6/1978 Czechoslovakia .
201475 3/1979 Czechoslovakia .
205826 3/1979 Czechoslovakia .
2010905 9/1971 Fed. Rep. of Germany ..... 139/435
2321364 11/1973 Fed. Rep. of Germany .
2600369 7/1977 Fed. Rep. of Germany ..... 139/435
2022630 12/1973 United Kingdom .

*Primary Examiner*—Henry Jaudon
*Attorney, Agent, or Firm*—Thompson, Birch, Gauthier & Samuels

[57] ABSTRACT

A weft picking device of an air jet loom, comprises a plurality of air guide members in alignment with the direction of weft picking, each air guide member being spaced predetermined distances from adjacent air guide members to define respective spaces therebetween, the air guide members being respectively formed with air guide openings to define a weft guide channel to which a weft yarn from a weft inserting nozzle is inserted, at least one auxiliary nozzle being disposed in a first section of a space between two adjacent air guide members, the space having a second section which is located opposite the first section relative to the axis of the weft guide channel, the width of the second section being less than that of the first section, thereby preventing the weft yarn from getting out of the weft guide channel to effectively accomplish weft picking.

8 Claims, 9 Drawing Figures

WEFT PICKING DEVICE OF AIR JET LOOM

BACKGROUND OF THE INVENTION

This invention relates to a weft picking device of an air jet loom, including a plurality of air guide members constituting a weft guide channel for guiding therethrough a weft yarn injected from a weft inserting nozzle or main nozzle under the influence of an air jet, and more particularly to the weft picking device which is provided with auxiliary nozzles in addition to the main nozzle for assisting the weft picking operation through the weft guide channel.

Hitherto, a weft picking device which is provided with a main nozzle and auxiliary nozzles has been proposed, in which a plurality of the auxiliary nozzles are positionable in the shed of warp yarns at a step of a loom operational cycle to assist the weft picking operation of the main nozzle. With this device, the auxiliary nozzles eject air jets to force and carry the weft yarn further forward. Thereafter, succeeding or further downstream side auxiliary nozzles eject air jets to take over the carrying operation of the weft yarn from the above-mentioned upstream side auxiliary nozzle. Such weft yarn carrying operation is taken over in succession by the successive auxiliary nozzles to complete a weft picking.

BRIEF SUMMARY OF THE INVENTION

The air jet loom weft picking device of the present invention comprises a plurality of air guide members in alignment with the direction of weft picking. Each air guide member is spaced predetermined distances from adjacent air guide members to define respective spaces therebetween. The air guide members are respectively formed with air guide openings to define a weft guide channel through which a weft yarn is inserted from a weft inserting nozzle. The weft picking device further comprises at least one auxiliary nozzle disposed in a first section of a space between two adjacent air guide members. The space includes a second section which is located opposite the first section relative to the axis of the weft guide channel, the width of the second section being less than that of the first section of the space. With this arrangement, air loss through wider alignment clearances of the air guide members can be decreased to equalize air leaks through all the air guide member alignment clearances, thereby preventing the weft yarn from flying out of the weft guide channel.

BRIEF DESCRIPTION OF THE DRAWINGS

The features and advantages of the air jet loom weft picking device according to the present invention will be more clearly appreciated from the following description taken in conjunction with the accompanying drawings in which the like reference numerals designate the like parts and elements, and in which.

DETAILED DESCRIPTION OF THE INVENTION

Figure 1:
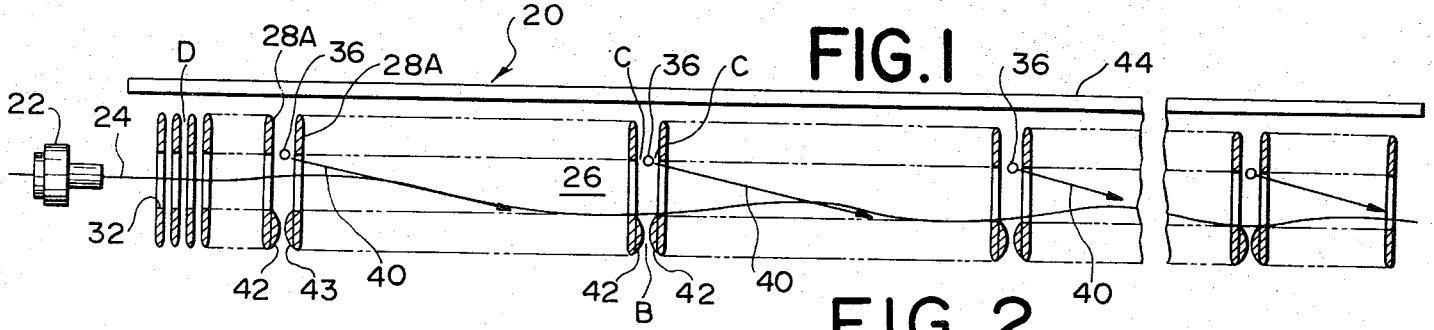
FIG. 1 is a transverse section view showing the arrangement of the air guide members of an embodiment of a weft picking device of an air jet loom according to the present invention.
Figure 2:
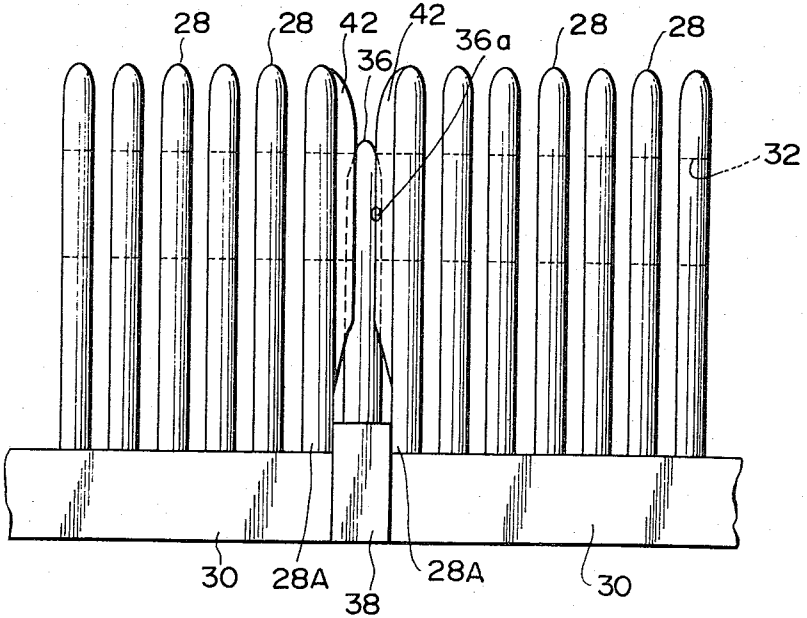
FIG. 2 is an enlarged front view of an essential part of the weft picking device of FIG. 1.
Figure 3:
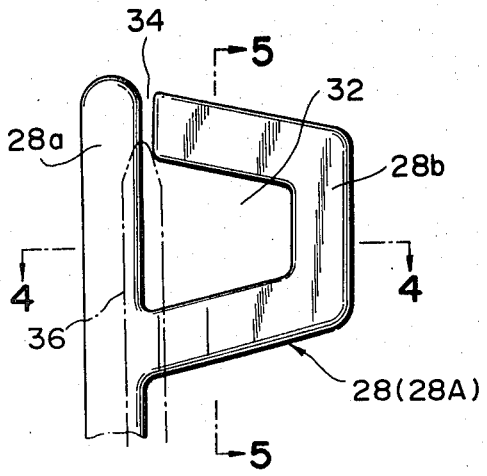
FIG. 3 is a side view of an air guide member of FIG. 2.

Reference is made to FIGS. 1 to 5 wherein a preferred embodiment of the weft picking device of an air jet loom, according to the present invention is illustrated by the reference numeral 20. The weft picking device 20 comprises a weft inserting nozzle or main nozzle 22 through which a weft yarn 24 is injected to be picked through a weft guide channel 26 formed by a plurality of air guide members 28 and 28A. The air guide member 28, 28A are aligned in the direction of weft picking at certain intervals and their base or foot sections are secured to an air guide holder 30. The air guide holder 30 is as usual secured onto a sley sword, not shown. Each air guide member 28 (28A) includes a straight section **28*a* and a curved section 28*b*, forming an air guide opening 32, having a slit 34 communicating therewith to allow the weft yarn 24 with the guide opening 32 to exit therethrough as shown in FIG. 3. The air guide guide openings 32 of the successively located air guide members 28 constitute the above-mentioned weft guide channel 26. The air guide members 28 are so located that the axis of the main nozzle 22 passes through the weft guide channel 26**.

A plurality of auxiliary nozzles 36 are aligned at approximately equal intervals along the weft picking direction. The body of each auxiliary nozzle 36 is pipe-shaped and its lower section is secured to an auxiliary nozzle holder 38 which is fixedly interposed between the air guide holders 30. The air guide holders are secured adjacent a reed 44 in a convenient manner. Each auxiliary nozzle 36 is constructed and arranged to be supplied with pressurized air, and is positioned between two suitable adjacent air guide members 28A. The auxiliary nozzle 36 is formed at its upper side wall with an air ejection oening **36*a* from which the pressurized air is angularly ejected as an air jet 40 in the direction of the arrows in FIG. 1**.

Figure 4:
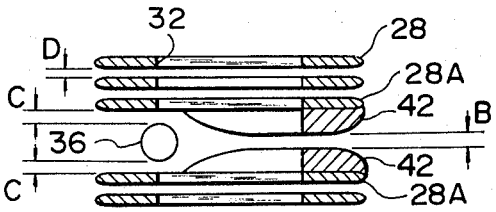
FIG. 4 is a cross-sectional view taken in the direction of arrows substantially along the line 4—4 of FIG. 3.
Figure 5:
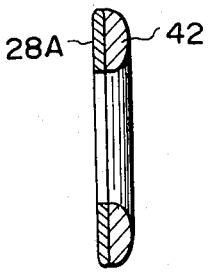
FIG. 5 is a cross-sectional view taken in the direction of the arrows substantially along the line 5—5 of FIG. 3.
Figure 6:
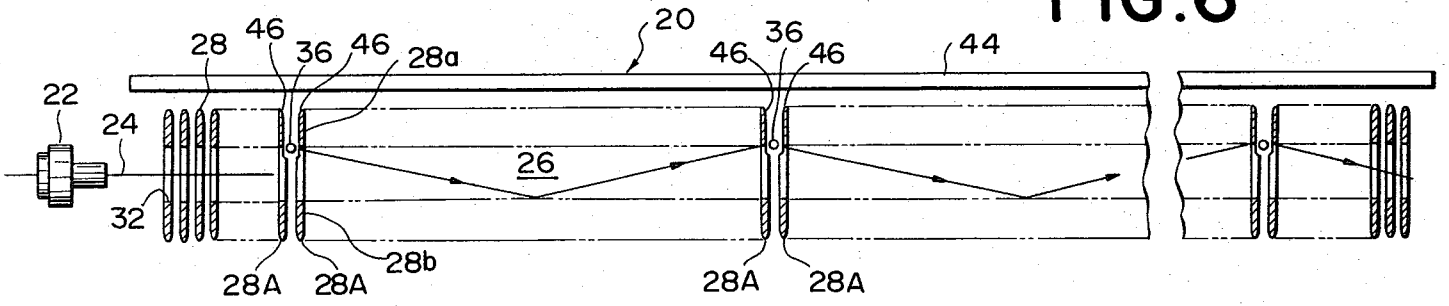
FIG. 6 is a transverse sectional view similar to FIG. 1 showing another embodiment of the present invention.
Figure 9:
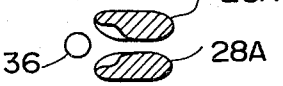
FIG. 9 is a cross-sectional view taken in the direction of the arrows substantially along the line 9—9 of FIG. 7.
Figure 8:
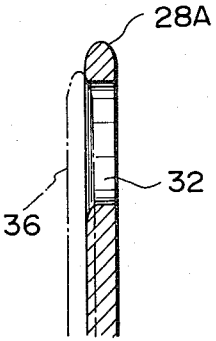
FIG. 8 is a cross-sectional view taken in the direction of the arrows substantially along the line 8—8 of FIG. 7.
Figure 7:
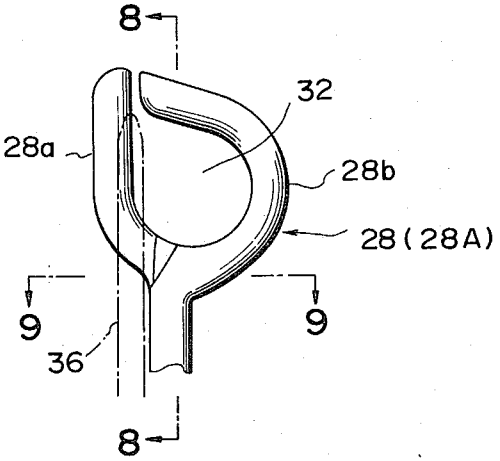
FIG. 7 is an enlarged side view of an air guide member used in the device of FIG. 6.

As best shown in FIG. 4, the two adjacent air guide members 28A between which an auxiliary nozzle 36 is interposed are formed at their facing surfaces with respective projections 42 which are positioned at a side opposite the auxiliary nozzle 36 with respect to the axis of the weft guide channel 26. More specifically, the projections 42 are formed respectively on the facing surfaces of the curved sections **28*b* of the two adjacent air guide members 28A, between which the auxiliary nozzle 36 is interposed. The projections 42 are, for example, formed on the surfaces of the air guide members by means of brazing. The distance B (see FIG. 4) between the two facing projections 42 is preferably approximately two times the distance C between the auxiliary nozzle 36 and the side surface of the air guide member straight section 28***a*, so that the distance B is approximately equal to the distance D between the remaining adjacent air guide members 28.

In operation, when the weft yarn 24 is injected from the main nozzle 22, the auxiliary nozzle 36 initiates ejection of an air jet immediately before the leading end of the weft yarn 24 reaches the vicinity of the auxiliary nozzle 36, so that the weft yarn 24 is pushed against the inner surface of the air guide member opening 32 at the side opposite the auxiliary nozzle, i.e., at the air guide member curved section 28*b*. A high speed air stream is formed along the inner wall surfaces of the air guide openings 32, leaking a suitable amount of air through each clearance between the projections 42. The weft yarn 24 is carried by this high speed air stream along the inner wall surface of the air guide member openings 32 to carry out weft picking through the weft guide channel 26.

As appreciated, the high speed air stream is mainly formed in the weft guide channel 26 along the opposite side of the auxiliary nozzles 36, i.e., along the air guide member curved section side. However, since the distance between the two adjacent air guide members 28A between which the auxiliary nozzle 36 is interposed, is narrowed in the air guide member curved section side by virtue of the projections 42, the amount of air leaked through the clearance between such air guide members 28A becomes generally the same as that in other regular alignment clearances of air guide member rows, and therefore, the weft yarn 24 can be prevented from flying out of the weft guide channel 26. Additionally, since the distance between the facing projections 42 is approximately two times the distance between the auxiliary nozzle 36 and the air guide member straight section 28*a*, warp yarns can smoothly pass through the clearances between the facing projections 42 during the operation of the loom.

FIGS. 6 to 9 illustrate another embodiment of the weft picking device in accordance with the present invention. In this embodiment, the generally circular air guide opening 32 is formed by the straight section 28*a* and the curved section 28*b*, in which the weft yarn 24 is carried by the high speed air stream formed in the vicinity of the axis of the weft guide channel 26, although the weft yarn actually meanders under the action of the air jets from the auxiliary nozzles 36 and the reflected air on the inner wall surfaces of the air guide member opening 32. The air guide member, in this embodiment, is formed relatively thick.

As shown, the thickness of the two adjacent air guide members 28A is smaller in the side at which the auxiliary nozzle 36 is positioned, i.e., at the straight section (28*a*) side as compared with the curved section (28*b*) side. More specifically, the thickness of the straight sections 28*a* of the two adjacent air guide members 28A between which the auxiliary nozzle 36 is interposed is smaller than that of the curved sections 28*b* of the same air guide members. As shown, the auxiliary nozzle 36 is so positioned to be interposed between such smaller thickness sections 46 of the two adjacent air guide members 28A. It will be appreciated that this embodiment exhibits the same effect as in the embodiment of FIGS. 1 to 5.

As appreciated from the above, according to the present invention, the distance between the two adjacent air guide members between which the auxiliary nozzle is positioned is narrow as compared with the air guide members of conventional weft picking devices, rendering that distance generally the same as that between other regular air guide members. This equalizes air leak amounts through all the alignment clearances of the air guide member row, thereby preventing the weft yarn from getting out of the weft guide channel.

What is claimed is:

1. A weft picking device of an air jet loom having a weft inserting nozzle, said device comprising:

a plurality of air guide members spaced one from the other and in alignment with the direction of weft insertion, said air guide members being respectively formed with air guide openings to define a weft guide channel, each air guide member having a substantially closed loop section defining the air guide opening, said loop section being formed with a slit through which a weft yarn may escape from the air guide opening;

an auxiliary nozzle disposed in a first section of the space between two adjacent air guide members; and means defining a second section of said space, the width of said second section being less than that of said first section, said second section being located opposite said first section relative to the axis of the weft guide channel.

2. A weft picking device as claimed in claim 1, wherein said second section defining means includes mutually spaced and opposed projections which are formed on the facing surfaces of said two adjacent air guide members, said projections defining the second section of said space therebetween.

3. A weft picking device as claimed in claim 2, wherein each of said two adjacent air guide members has a generally straight section adjacent to a generally curved section, said straight and curved sections cooperating to define said substantially closed loop section, said projections being formed on said curved sections.

4. A weft picking device as claimed in claim 3, wherein the distance between said two projections is two times the distance between said auxiliary nozzle and the inner side surface of said straight section of each of said two adjacent air guide members.

5. A weft picking device as claimed in claim 1, wherein said second section defining means includes the walls of two facing and spaced air guide members defining said second section therebetween, said two air guide member walls being larger in thickness than those defining said space first section therebetween.

6. A weft picking device as claimed in claim 5, wherein each of said two adjacent air guide members has a generally straight section and a generally curved section, said straight and curved sections cooperating to define said substantially closed loop section, in which said curved section is larger in thickness than said straight section.

7. A weft picking device as claimed in claim 6, wherein the outer side surface of said straight section lies on the same plane as that of said curved section, but the inner side surface of said straight section is offset relative to that of said curved section.

8. A weft picking device of an air jet loom having a weft inserting nozzle, said device comprising:

a plurality of mutually spaced air guide members in alignment with the direction of weft insertion, said air guide members being respectively formed with air guide openings to define a weft guide channel, each air guide member having a substantially closed loop section defining the air guide opening, said loop section being formed with a slit through which a weft yarn may escape from the air guide opening;

an auxiliary nozzle disposed in a first section of the space between two adjacent air guide members, said auxiliary nozzle being parallel to the portions of said air guide members defining said first section; and means defining a second section of said space, the width of said second section being less than that of said first section, said second section being located opposite said first section relative to the axis of the weft guide channel.

* * * * *